United States Patent [19]

Robinson et al.

[11] Patent Number: 4,741,819

[45] Date of Patent: May 3, 1988

[54] SULFUR REMOVAL SYSTEM FOR PROTECTION OF REFORMING CATALYST

[75] Inventors: Richard C. Robinson, San Rafael; Robert L. Jacobson, Vallejo; Leslie A. Field, Emeryville, all of Calif.

[73] Assignee: Chevron Research Company, San Francisco, Calif.

[21] Appl. No.: 667,505

[22] Filed: Oct. 31, 1984

[51] Int. Cl.[4] ..... C10G 35/06

[52] U.S. Cl. ..... 208/65; 208/62; 208/66; 208/89; 208/99; 208/212

[58] Field of Search ..... 208/65, 89, 212, 62, 208/66, 99

[56] References Cited

U.S. PATENT DOCUMENTS

| | | | |
|---|---|---|---|
| 2,856,347 | 10/1958 | Seelig et al. | 208/89 |
| 3,706,653 | 12/1972 | Mills et al. | 208/65 |
| 3,769,201 | 10/1973 | Sinfelt et al. | 208/65 |
| 3,898,153 | 8/1975 | Louder et al. | 208/89 |
| 4,155,835 | 5/1979 | Antal | 208/89 |
| 4,348,271 | 9/1982 | Swan | 208/65 |

*Primary Examiner*—William R. Dixon, Jr.
*Assistant Examiner*—Cynthia A. Prezlock
*Attorney, Agent, or Firm*—S. R. La Paglia; E. A. Schaal; P. L. McGarrigle, Jr.

[57] ABSTRACT

A process for removing residual sulfur from a hydrotreated naphtha feedstock is disclosed. The feedstock is contacted with molecular hydrogen under reforming conditions in the presence of a less sulfur sensitive reforming catalyst, thereby converting trace sulfur compounds to $H_2S$, and forming a first effluent. The first effluent is contacted with a solid sulfur sorbent, removing the $H_2S$ and forming a second effluent. The second effluent is contacted with a highly selective reforming catalyst under severe reforming conditions.

17 Claims, No Drawings

SULFUR REMOVAL SYSTEM FOR PROTECTION OF REFORMING CATALYST

BACKGROUND OF THE INVENTION

This invention relates to the removal of sulfur from a hydrocarbon feedstock, particularly the removal of extremely small quantities of thiophene sulfur.

Generally, sulfur occurs in petroleum and syncrude stocks as hydrogen sulfide, organic sulfides, organic disulfides, mercaptans, also known as thiols, and aromatic ring compounds such as thiophene, benzothiophene and related compounds. The sulfur is aromatic sulfur-containing ring compounds will be herein referred to as "thiophene sulfur".

Conventionally, feeds with substantial amounts of sulfur, for example, those with more than 10 ppm sulfur, are hydrotreated with conventional catalysts under conventional conditions, thereby changing the form of most of the sulfur in the feed to hydrogen sulfide. Then the hydrogen sulfide is removed by distillation, stripping or related techniques. Such techniques can leave some traces of sulfur in the feed, including thiophenic sulfur, which is the most difficult type to convert.

Such hydrotreated naphtha feeds are frequently used as feed for catalytic dehydrocyclization, also known as reforming. Some of these catalysts are extremely sulfur sensitive, particularly those that contain zeolitic components. Others of these catalysts can tolerate sulfur in the levels found in typical reforming feeds.

One conventional method of removing residual hydrogen sulfide and mercaptan sulfur is the use of sulfur sorbents. See for example U.S. Pat. Nos. 4,204,997 and 4,163,708, both by R. L. Jacobson and K. R. Gibson. The concentration of sulfur in this form can be reduced to considerably less than 1 ppm by the use of the appropriate sorbent and conditions, but it is difficult to remove sulfur to less than 0.1 ppm or to remove any residual thiophene sulfur. See for example U.S. Pat. No. 4,179,361 by M. J. Michlmayr, and particularly Example 1 in that Patent. In particular, very low space velocities are required, to remove thiophene sulfur, requiring large reaction vessels filled with sorbent, and even with these precautions, traces of thiophene sulfur can get through.

It would be advantageous to have a process to remove most sulfur, including thiophene sulfur, from a reforming feedstream.

SUMMARY OF THE INVENTION

This invention provides a method for removing residual sulfur from a hydrotreated naphtha feedstock comprising:

(a) contacting the feedstock with hydrogen under mild reforming conditions in the presence of a less sulfur sensitive reforming catalyst, thereby carrying out some reforming reactions and also converting trace sulfur compounds to $H_2S$ and forming a first effluent;

(b) contacting said first effluent with a solid sulfur sorbent, to remove the $H_2S$, thereby forming a second effluent which is less than 0.1 ppm sulfur;

(c) contacting said second effluent with a highly selective reforming catalyst which is more sulfur sensitive under severe reforming coditions in subsequent reactors.

DETAILED DESCRIPTION

The naphtha fraction of crude distillate, containing low molecular weight sulfur-containing impurities, such as mercaptans, thiophene, and the like, is usually subjected to a preliminary hydrodesulfurization treatment. The effluent from this treatment is subjected to distillation-like processes to remove $H_2S$. The effluent from the distillation step will typically contain between 0.2 and 5 ppm sulfur, and between 0.1 and 2 ppm thiophene sulfur. This may be enough to poison selective sulfur sensitive reforming catalysts in a short period of time. So the resulting product stream, which is the feedstream to the reforming step, is then contacted with a highly efficient sulfur sorbent before being contacted with the sensitive reforming catalyst. Contacting this stream with a conventional sulfur sorbent removes most of the easily removed $H_2S$ sulfur and most of the mercaptans but tends to leave any unconverted thiophene sulfur. Sulfur sorbents that effectively remove thiophene sulfur require low space velocities; for example, liquid hourly space velocities of less than 1 $hr.^{-1}$ have been reported in actual examples.

FIRST REFORMING CATALYST

The first reforming catalyst is a less sulfur sensitive catalyst which is a Group VIII metal plus a promotor metal if desired supported on a refractory inorganic oxide metal. Suitable refractory inorganic oxide supports include alumina, silica, titania, magnesia, boria, and the like and combinations, for example silica and alumina or naturally occurring oxide mixtures such as clays. The preferred Group VIII metal is platinum. Also a promoter metal, such as rhenium, tin, germanium, iridium, rhodium, and ruthenium, may be present. Preferably, the less sulfur sensitive reforming catalyst comprises platinum plus a promoter metal such as rhenium if desired, an alumina support, and the accompanying chloride. Such a reforming catalyst is discussed fully in U.S. Pat. No. 3,415,737, which is hereby incorporated by reference.

The hydrocarbon conversion process with the first reforming catalyst is carried out in the presence of hydrogen at a pressure adjusted so as to favor the dehydrogenation reaction thermodynamically and limit undesirable hydrocracking reaction by kinetic means. The pressures used vary from 15 psig to 500 psig, and are preferably between from about 50 psig to about 300 psig; the molar ratio of hydrogen to hydrocarbons preferably being from 1:1 to 10:1, more preferably from 2:1 to 6:1.

The sulfur conversion reaction occurs with acceptable speed and selectively in the temperature range of from 300° C. to 500° C. Therefore, the first reforming reactor is preferably operated at a temperature in the range of between about 350° C. and 480° C. which is known as mild reforming conditions.

When the operating temperature of the first reactor is more than about 300° C., the sulfur conversion reaction speed is sufficient to accomplish the desired reactions. At higher temperatures, such as 400° C. or more, some reforming reactions, particularly dehydrogenation of naphthenes, begin to accompany the sulfur conversion. These reforming reactions are endothermic and can result in a temperature drop of 10°-50° C. as the stream passes through the first reactor. When the operating temperature of the first reactor is above 500° C., an unnecessarily large amount of reforming takes place which is accompanied by hydrocracking and coking. In order to minimize these undesirable side reactions, we limit the first reactor temperature to about 500° C. or preferably 480° C. The liquid hourly space velocity of the hydrocarbons in the first reforming reactor reaction is preferably between 3 and 15.

Reforming catalysts have varying sensitivities to sulfur in the feedstream. Some reforming catalysts are less sensitive, and do not shown substantially reduced activity if the sulfur level is kept below about 5 ppm. When they are deactivated by sulfur and coke buildup they can generally be regenerated by burning off the sulfur and coke deposits. Preferably, the first reforming catalyst is this type.

SULFUR SORBENT

The effluent from the first reforming step, hereinafter the "first effluent", is then contacted with a sulfur sorbent. This sulfur sorbent must be capable of removing the $H_2S$ from the first effluent to less than 0.1 ppm at mild reforming temperatures, about 300° to 450° C. Several sulfur sorbents are known to work well at these temperatures. The sorbent reduces the amount of sulfur in the feedstream to amounts less than 0.1 ppm, thereby producing what will hereinafter be referred to as the "second effluent". However, the water level should be kept fairly low, preferably to less than 100 ppm, and more preferably to less than 50 ppm in the hydrogen recycle stream.

The sulfur sorbent of this invention will contain a metal that readily reacts to form a metal sulfide supported by a refractory inorganic oxide or carbon support. Preferable metals include zinc, molybdenum, cobalt, tungsten potassium, sodium, calcium, barium, and the like. The support preferred for potassium, sodium, calcium and barium is the refractory inorganic oxides, for example, alumina, silica, boria, magnesia, titania, and the like. In addition, zinc can be supported on fibrous magnesium silicate clays, such as attapulgite, sepiolite, and palygorskite. A particularly preferred support is one of attapulgite clay with about 5 to 30 weight percent binder oxide added for increased crush strength. Binder oxides can include refractory inorganic oxides, for example, alumina, silica, titania and magnesia.

A preferred sulfur sorbent of this invention will be a support containing between 20 and 40 weight percent of the metal. The metal can be placed on the support in any conventional manner, such as impregnation. But the preferred method is to mull a metal-containing compound with the support to form an extrudable paste. The paste is extruded and the extrudate dried and calcined. Typical metal compounds that can be used are the metal carbonates which decompose to form the oxide upon calcining.

The effluent from the sulfur sorber, which is the vessel containing the sulfur sorbent, hereinafter the second effluent, will contain less than 0.1 ppm sulfur and preferably less than 0.05 ppm sulfur. The sulfur levels can be maintained as low as 0.05 ppm for long periods of time. Since both the less sulfur sensitive reforming catalyst and the solid sulfur sorbent can be nearly the same size a possible and preferred embodiment of this invention is that the less sulfur sensitive reforming catalyst and the solid sulfur sorbent are layered in the same reactor. Then the thiophene sulfur can be converted to hydrogen sulfide and removed in a single process unit.

In one embodiment, more than one sulfur sorbent is used. In this embodiment, a first sulfur sorbent, such as zinc or zinc oxide on a carrier to produce a sulfurlean effluent, then a second sulfur sorbent, such as a metal compound of Group IA or Group IIA metal is used to reduce the hydrogen sulfide level of the effluent to below 50 ppb, then the effluent is contacted with the highly selective reforming catalyst.

THE MORE SELECTIVE REFORMING CATALYSTS

The second effluent is contacted with a more selective and more sulfur sensitive reforming catalyst at higher temperatures typical of reforming units. The paraffinic components of the feedstock are cyclized and aromatized while in contact with this more selective reforming catalyst. The removal of sulfur from the feed stream in the first two steps of this invention make it possible to attain a much longer life than is possible without sulfur protection.

The more selective reforming catalyst of this invention is a large-pore zeolite charged with one or more dehydrogenating constituents. The term "large-pore zeolite" is defined as a zeolite having an effective pore diameter of 6 to 15 Angstroms.

Among the large-pore crystalline zeolites which have been found to be useful in the practice of the present invention, type L zeolite, zeolite X, zeolite Y and faujasite are the most important and have apparent pore sizes on the order to 7 to 9 Angstroms.

A composition of type L zeolite, expressed in terms of mole ratios of oxides, may be represented as follows:

$$(0.9\text{–}1.3)M_{2/n}O:AL_2O_3(5.2\text{–}6.9)SiO_2:yH_2O$$

wherein M designates a cation, n represents the valence of M, and y may be any value from 0 to about 9. Zeolite L, its X-ray diffraction pattern, its properties, and method for its preparation are described in detail in U.S. Pat. No. 3,216,789. The real formula may vary without changing the crystalline structure; for example, the mole ratio of silicon to aluminum (Si/Al) may vary from 1/.0 to 3.5.

The chemical formula for zeolite Y expressed in terms of mole ratios of oxides may be written as:

$$(0.7\text{–}1.1)Na_2O:Al_2O_3:xSIO_2:yH_2O$$

wherein x is a value greater than 3 up to about 6 and Y may be a value up to about 9. Zeolite Y has a characteristic X-ray powder diffraction pattern which may be employed with the above formula for identification. Zeolite Y is described in more detail in U.S. Pat. No. 3,130,007. U.S. Pat. No. 3,130,007 is hereby incorporated by reference to show a zeolite useful in the present invention.

Zeolite X is a synthetic crystalline zeolitic molecular sieve which may be represented by the formula:

$$(0.7\text{–}1.1)M_{2/n}O:Al_2O_3:(2.0\text{–}3.0)SiO_2:yH_2O$$

wherein M represents a metal, particularly alkali and alkaline earth metals, n is the valence of M, and y may have any value up to about 8 depending on the identity of M and the degree of hydration of the crystalline zeolite. Zeolite X, its X-ray diffraction pattern, its properties, and method for its preparation are described in detail in U.S. Pat. No. 2,882,244.

It is preferred that the more sulfur sensitive reforming catalyst of this invention is a type L zeolite charged with one or more dehydrogenating constituents.

A preferred element of the present invention is the presence of an alkaline earth metal in the large-pore zeolite. That alkaline earth metal may be either barium, strontium or calcium, preferably barium. The alkaline earth metal can be incorporated into the zeolite by synthesis, impregnation or ion exchange. Barium is preferred to the other alkaline earths because it results in a somewhat less acidic catalyst. Strong acidity is undesirable in the catalyst because it promotes cracking, resulting in lower selectivity.

In one embodiment, at least part of the alkali metal is exchanged with barium, using techniques known for ion exchange of zeolites. This involves contacting the zeolite with a solution containing excess $Ba^{++}$ ions. The barium should constitute from 0.1% to 35% of the weight of the zeolite.

The large-pore zeolitic dehydrocyclization catalysts according to the invention are charged with one or more Group VIII metals, e.g., nickel, ruthenium, rhodium, palladium, iridium or platinum.

The preferred Group VIII metals are iridiuim and particularly platinum, which are more selective with regard to dehydrocyclization and are also more stable under the dehydrocyclization conditions than other Group VIII metals.

The preferred percentage of platinum in the dehydrocyclization catalyst is between 0.1% and 5%, preferably from 0.2% to 1%.

Group VIII metals are introduced into the large-pore zeolite by snythesis, impregnation or exchange in an aqueous solution of appropriate salt. When it is desired to introduce two Group VIII metals into the zeolite, the operation may be carried out simultaneously or sequentially.

EXAMPLE 1

This is an example of the present invention. A feedstock containing measured amounts of various impurities was passed over a reforming catalyst and then a sulfur sorbent. The less sensitive reforming catalyst was made by the method of U.S. Pat. No. 3,415,737.

The sulfur sorbent was prepared by mixing 150 grams alumina with 450 grams attapulgite clay, adding 800 grams zinc carbonate, and mixing the dry powders together. Enough water was added to the mixture to make a mixable paste which was then extruded. The resulting extrudate was dried and calcined.

The sulfur sorbent had properties as follows:

| | |
|---|---|
| Bulk density | 0.70 gm/cc |
| Pore volume | 0.60 cc/gm |
| $N_2$ surface area | 86 $m^2$/gm; and |
| Crush strength | 1.5 lbs/mm. |

The final catalyst contained approximately 40 wt.% zinc as metal.

A reformer feed was first contacted with the lens sensitive reforming catalyst and then with the sulfur sorber. Thiophene was added to a sulfur free feed to bring the sulfur level to about 10 ppm. The product from the sulfur sorber was analyzed for sulfur. If the level was below 0.1 ppm it could have been used as feed for a more sulfur sensitive reforming catalyst.

The data is tabulated on Table I.

TABLE I

| Day | Feed Sulfur (ppm) | 1st Reactor Temperature °F. | 2nd Reactor Temperature °F. | Sulfur (ppm) Analysis |
|---|---|---|---|---|
| 1–7 | 11.7 | 850 (454° C.) | 650 (343° C.) | 0.05 |
| 7–9 | 7.2 | 850 " | 650 " | <0.04 |
| 9–12 | 8.0 | 850 " | 650 " | <0.05 |
| 13 | 10.5 | 850 " | 650 " | 0.06 |
| 14–15 | 10.5 | 850 " | 700 (370° C.) | |
| 16 | 10.5 | 800 (425° C.) | 700 " | 0.04 |
| 17–19 | 10.5 | 750 (400° C.) | 700 " | 0.04 |
| 20–21 | 10.5 | 700 (370° C.) | 700 " | |
| 22–23 | 8.6 | 700 " | 700 " | <0.04 |
| 24–28 | 8.4 | 700 " | 700 " | <0.04 |

EXAMPLE 2

A small hydroprocessing reactor was set up containing: 25 cubic centimeters of a mixture of platinum on alumina, as the less sensitive reforming catalyst, and zinc oxide on alumina, as the sulfur sorbent. The effluent from this reactor was passed over 100 cc of L zeolite that had been barium exchanged, which is a highly selective, but vary sulfur sensitive reforming catalyst. The feedstock was a light naphtha feedstock. The results are shown in Table II. One ppm sulfur was added to the feed at 300 hours. The temperature was increased to provide a total $C_5+$ yield of 88.5 volume percent.

TABLE II

| Hours of Operation | Temperature °F. |
|---|---|
| 200 | 855 |
| 400 | 860 |
| 600 | 860 |
| 800 | 870 |
| 1000 | 875 |
| 1200 | 875 |

COMPARATIVE EXAMPLE

When the same L zeolite reforming catalyst is used in the presence of sulfur, it is rapidly deactivated. The temperature was to be adjusted upwards to maintain a constant $C_5+$ make, but 0.5 ppm sulfur was added at 270 to 360 hours on stream, and no sulfur protection was present. The reforming catalyst deactivated so rapidly that after 450 hours it was no longer possible to maintain a constant $C_5+$ make. The results are shown in Table III.

TABLE III

| Run time, Hrs. | For 50 wt % Aromatics in Liquid. Temperature °F. | $C_5+$ Yield LV % |
|---|---|---|
| 200 | 862 | 84.2 |
| 300 | 864 | 85.0 |
| 350 | 876 | 85.6 |
| 400 | 887 | 85.6 |
| 450 | 896 | 85.5 |
| 500 | 904 | 85.8 |

The comparison shows how totally this invention protects the more sulfur sensitive catalyst adding greatly to its life.

The preceding examples are illustrative of preferred embodiments of this invention, and are not intended to narrow the scope of the appended claims.

What is claimed is:

1. A method for removing residual sulfur from a hydrotreated naphtha feedstock comprising:

(a) contacting said feedstock with hydrogen under mild reforming conditions in the presence of a less sulfur sensitive reforming catalyst that requires sulfiding, thereby carrying out some reforming reactions and also converting trace sulfur compounds to $H_2S$ and forming a first effluent;

(b) contacting said first effluent with a solid sulfur sorbent to remove the $H_2S$, thereby forming a second effluent which contains less than 0.1 ppm sulfur;

(c) contacting said second effluent with a highly selective reforming catalyst, which is more sulfur sensitive, in subsequent reactors.

2. The process of claim 1 wherein said feedstock contains from 0.2 to 10 ppm sulfur.

3. The process of claim 1 wherein said feedstock contains from 0.1 to 5 ppm thiophene sulfur.

4. The process of claim 1 wherein said second effluent contains no more than 0.01 ppm sulfur.

5. The process of claim 1 wherein said second effluent contains no more than 0.05 ppm thiophene sulfur.

6. The process of claim 1 wherein said feedstock is contacted with said first reforming catalyst at a liquid hourly space velocity of at least 5 $hr.^{-1}$.

7. The process of claim 1 wherein said first effluent stream is contacted with said sulfur sorbent at a liquid hourly space velocity of at least 3 $hr.^{-1}$ and more preferably more than 5 $hr^{-1}$.

8. The process of claim 1 wherein said first reforming conversion catalyst comprises a Group VIII catalytic metal, disposed on a refractory inorganic oxide.

9. The process of claim 1 wherein said sulfur sorbent includes a metal selected from the group consisting of zinc, molybdenum, cobalt, tungsten supported on a refractory inorganic material porous support.

10. The process of claim 9 wherein said porous support is selected from the group consisting of alumina, silica, titania, magnesia and carbon.

11. The process of claim 9 wherein said porous support includes attapulgite clay.

12. The process of claim 11 wherein said porous support contains a binder oxide selected from the group consisting of alumina, silica, titania and magnesia.

13. The process of claim 1 wherein said sulfur sorbent contains a metal compound of which the metal is selected from Group I-A or Group II-A of the periodic table supported on a refractory inorganic oxide.

14. The process of claim 13 wherein said metal is selected from the group consisting of sodium, potassium, barium, and calcium.

15. The process of claim 13 wherein said refractory inorganic oxide is alumina.

16. The process of claim 1 wherein said trace sulfur compounds contain primarily thiophene sulfur.

17. The process of claim 1 wherein said less sulfur sensitive reforming catalyst and said solid sulfur sorbent are intermixed in the same reaction vessel.

* * * * *